United States Patent [19]

Voegeli et al.

[11] Patent Number: 4,739,597

[45] Date of Patent: Apr. 26, 1988

[54] EASILY DISASSEMBLABLE ENCLOSURE AND METHOD FOR ASSEMBLING SAME

[76] Inventors: Ronald C. Voegeli, 918 Gibbs Rd., Venice, Fla. 33595; David L. Arp, 200 N. Oxford Dr., Englewood, Fla. 33533

[21] Appl. No.: 766,286

[22] Filed: Aug. 16, 1985

[51] Int. Cl.[4] ..... E04C 2/34

[52] U.S. Cl. ..... 52/227; 52/228; 52/775

[58] Field of Search ..... 52/90, 93, 228, 766, 52/227, 781, 775; 405/285; 98/115.2

[56] References Cited

U.S. PATENT DOCUMENTS

| | | | |
|---|---|---|---|
| 799,765 | 9/1905 | Powell | 52/93 |
| 1,688,953 | 10/1928 | Yeager | 52/766 |
| 2,989,154 | 6/1961 | Colby | 52/93 |
| 3,052,291 | 9/1962 | Fellers | 52/775 X |
| 3,292,325 | 12/1966 | Nicolini | 52/227 |
| 3,370,404 | 2/1968 | Leeper | 98/115.2 |
| 3,464,168 | 9/1969 | Russell et al. | 52/227 X |
| 4,069,627 | 1/1978 | Pegg | 52/90 |
| 4,294,051 | 10/1981 | Hughes | 52/90 |

*Primary Examiner*—Carl D. Friedman

*Attorney, Agent, or Firm*—Burns, Doane, Swecker & Mathis

[57] ABSTRACT

An enclosure comprises a plurality of modules arranged in a longitudinal direction. Each module comprises a pair of longitudinally spaced frames separated by wall panels extending along the sides and top of the enclosure. The frames are secured together by tensioned cables which press the frames together and hold the wall panels within channels formed in the frames. Two of the top wall panels are inclined at an oblique angle and have upper and lower longitudinal edges which bear against corresponding edges of adjacent wall panels. Portions of the inclined wall panels and/or adjacent panels are bent to assure proper engagement therebetween. Removable locking plates prevent removal of the inclined wall panels.

4 Claims, 7 Drawing Sheets

10
12 B
20 B1
20 A2
12 A
4
92 A
92 B
73
70
74
72
24 A4
24 B4
50
20 A1
90 B
90 A
80
24 B3
24 A3
42
44
106
24 B2
24 A2
104
24 B1
24 A1

92A
12A
13
102
92A
20A1
90A
13
90A
12
12
106
106
104
104

10
92E
90D
55
38
12D
20D
11
70
24C5
123
24C6
24C7
24C8
24C4
24C4
90E
90D
24C3
24C3
123
24C2
45
24C2
36
36
123
123
24C1
24C1

119
11
12C
119
70
70
24C8
24C6
20C2
112
122
150
118
118
36
122
118
24C1
118

120
119
118
110
114
120
119
122
122
118
112
112
118
118

Fig. 12
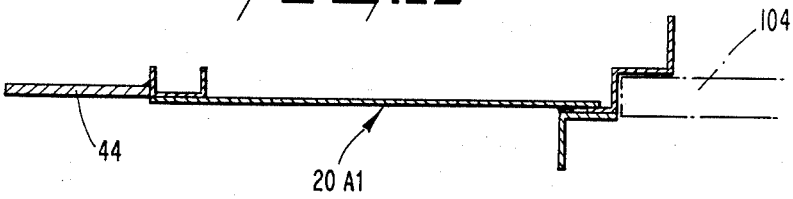
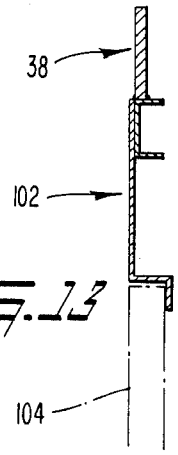
Fig. 13
Fig. 14
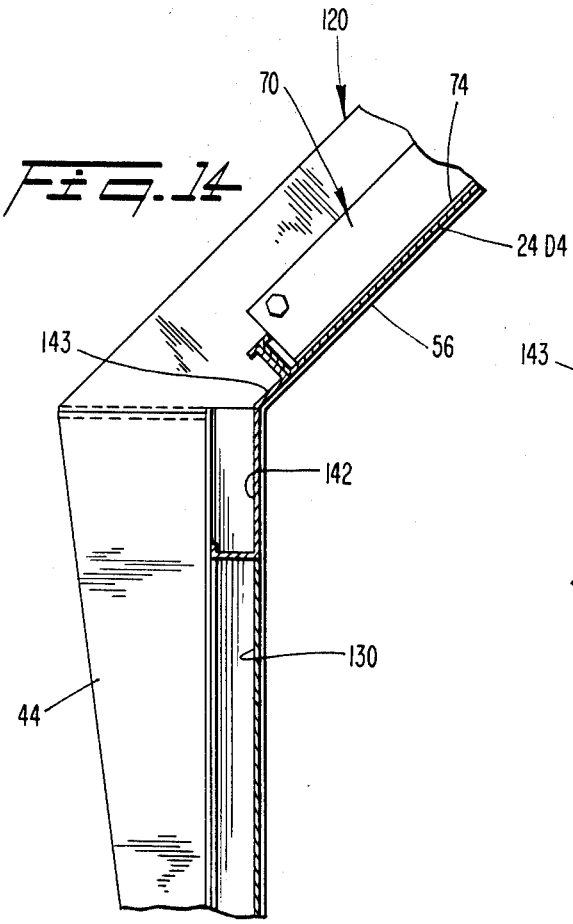
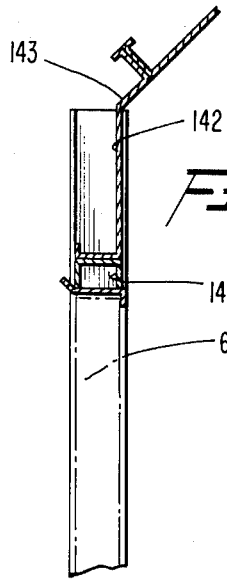
Fig. 15
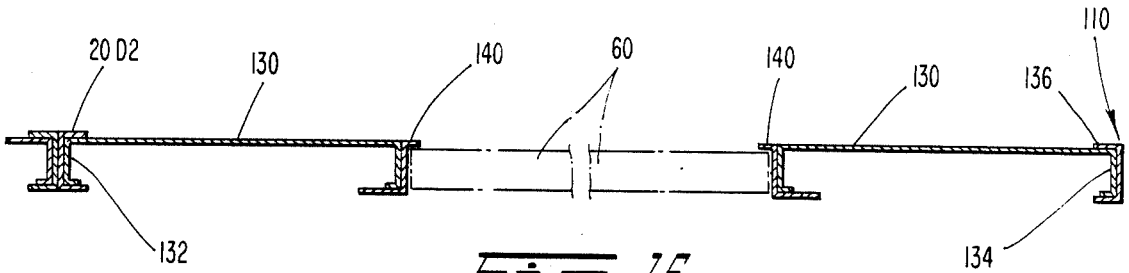
Fig. 16

EASILY DISASSEMBLABLE ENCLOSURE AND METHOD FOR ASSEMBLING SAME

BACKGROUND AND OBJECTS OF THE INVENTION

The present invention relates to building-size enclosures which can be disassembled and transported, such as an enclosure in which objects such as automobiles can be painted and dried.

Building-size enclosures used for activities such as the painting of automobiles for example have, in some cases, been constructed in a manner which enables the enclosure to be disassembled and transported to a different site. Such a capability has particular utility to businesses which rent such enclosures for temporary use. Typically, such enclosures will comprise upstanding frames to which are fastened sheet metal panels to define the sides and roof of the enclosure. One particularly evident shortcoming associated with such enclosures involves the considerable amount of time required to assemble (and disassemble) the components of the enclosure, due to the many fasteners, e.g., bolts, which are employed to bolt the sheet metal panels to each other and to the frames. This shortcoming is further complicated if, as is often the case, the pre-drilled holes for receiving the bolts do not properly line-up with one another and/or if the bolts and nuts become rusted.

It is, therefore, an object of the present invention to minimize or obviate problems of the type discussed above.

Another object is to provide a building-size enclosure which is quickly and easily assembled and disassembled.

A further object is to provide such an enclosure whose assembly and disassembly involves a minimal number of fasteners.

An additional object is to provide such an assembly wherein cables provide a substantial portion of the forces holding the enclosure components together.

SUMMARY OF THE INVENTION

These objects are achieved by the present invention which relates to an enclosure, preferably employed as a painting and drying facility for automobiles. The enclosure comprises a pair of frames spaced apart in a longitudinal direction. Each frame includes a pair of upstanding portions and a connecting portion interconnecting upper ends of the upstanding portions. Each frame includes a receiver means preferably in the form of channels disposed in the upright and interconnecting portions. The channels of each frame face toward the channels of the other frame. A plurality of wall panels extend in the longitudinal direction between the frames along the upright and connecting portions. Each wall panel includes one longitudinal end mating with the channel of one frame to prevent lateral movement of that one end, and an opposite longitudinal end mating with the channel of the other frame to prevent lateral movement of such second end. Elongate tensioning means, preferably in the form of cables, extend between the frames and are tensioned to urge the frames toward one another and against the ends of the panels.

The present invention also relates to a method of assembling a structure of that type.

BRIEF DESCRIPTION OF THE DRAWING

The objects and advantages of the invention will become apparent from the following detailed description of a preferred embodiment thereof in connection with the accompanying drawings in which like numerals designate like elements, and in which:

FIGS. 12 and 13 are cross-sectional views taken along lines 12—12 and 13—13 respectively, in FIG. 4; and FIGS. 14, 15 and 16 are cross-sectional views taken along lines 14—14, 15—15, and 16—16, respectively, in FIG. 1.

DETAILED DESCRIPTION OF A PREFERRED EMBODIMENT OF THE INVENTION

Figure 5:
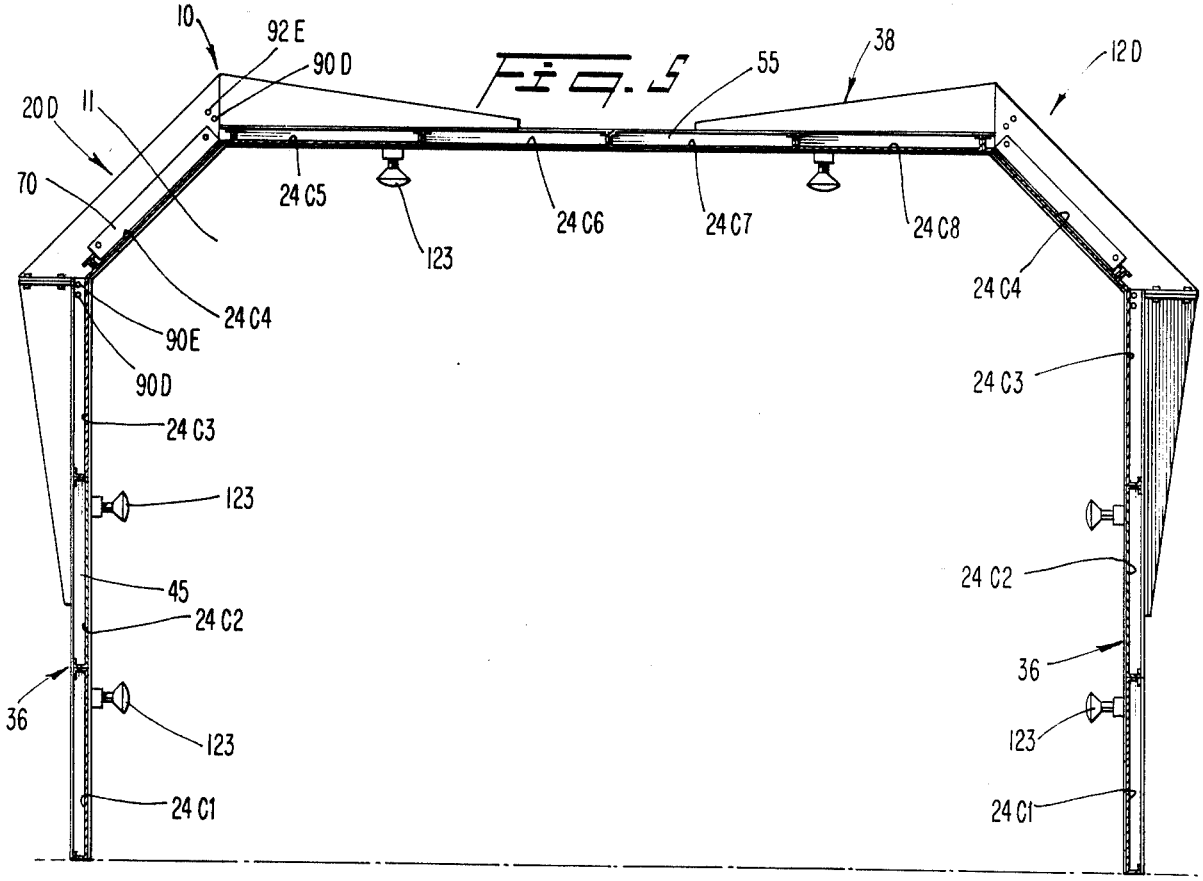
FIG. 5 is a cross-sectional view through a heating section of the enclosure taken along the line 5—5 in FIG. 1.

A building-size enclosure 10 defines an internal chamber 11 (FIG. 5) preferably to be used for the painting and drying of automobiles. The enclosure comprises a plurality of modular sections 12, in particular, modules 12A to 12F, which are secured together in series in a longitudinal direction to enclose the internal chamber.

Each modular section comprises a pair of upstanding frames 20, in particular, frames 20A1 20A2; 20B1, 20B2; 20C1, 20C2; 20D1, 20D2; 20E1, 20E2; and 20F1, 20F2; and a plurality of wall panels 24, in particular panels 24A–24F which extend between respective pairs of frames. The frames 20 of each pair of frames are spaced apart horizontally by a distance corresponding to the length of each wall panel.

Figure 2:
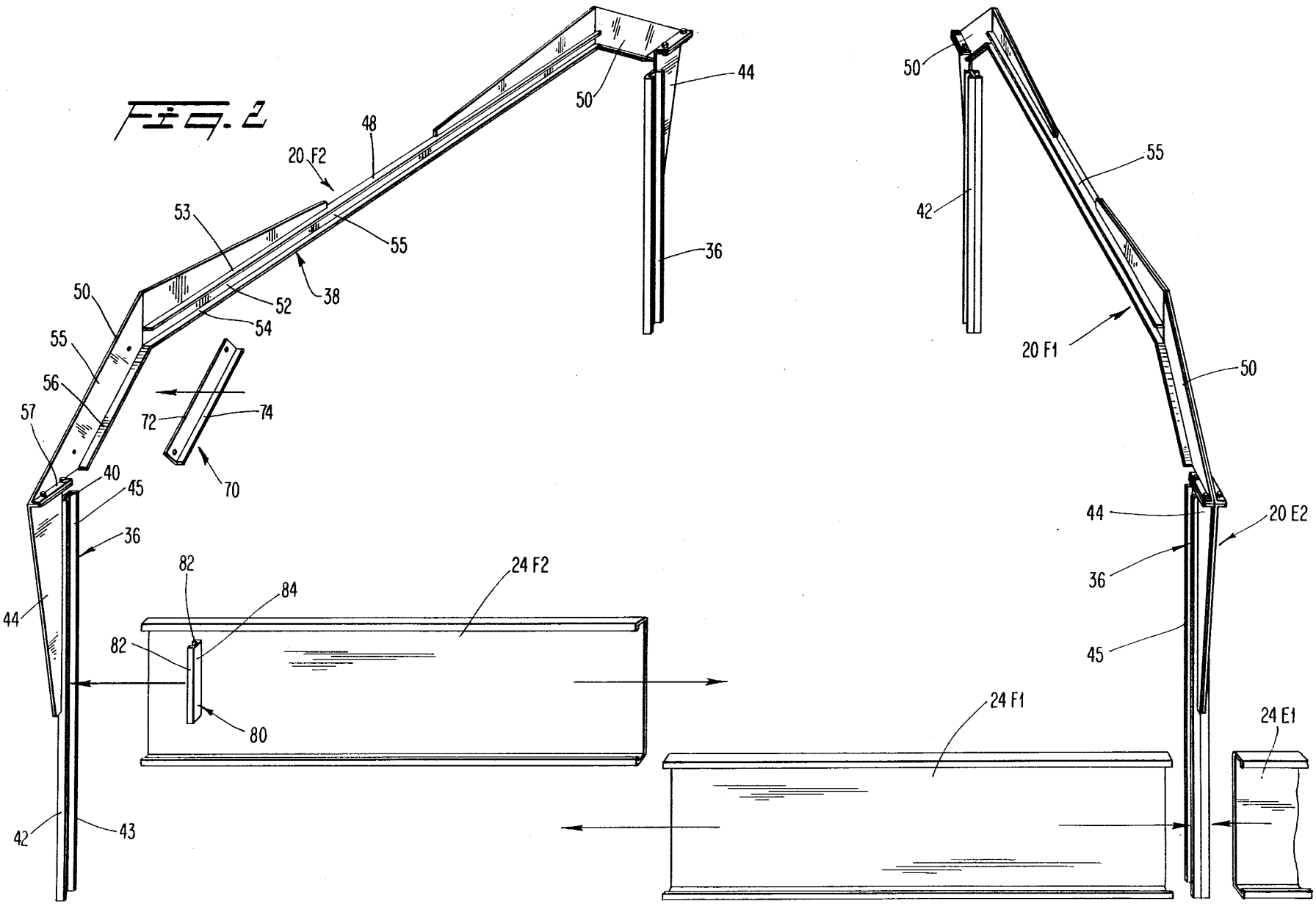
FIG. 2 is an exploded perspective view of two frames of a module, the frames spaced longitudinally apart with a pair of wall panels situated therebetween.

Each frame 20 is of arch-like configuration as is apparent from the frames 20F1, 20F2 depicted in FIG. 2. The horizontal spacing between the frames 20F1, 20F2 is exaggerated in FIG. 2; in a assembled structure such horizontal spacing corresponds to the horizontal length of one wall panel 24. Some frames are disposed in back-to-back relationship, i.e., frames 20A2, 20B1; 20B2, 20C1; 20D2, 20E1; and 20E2, 20F1, and are welded together to form an integral frame unit.

Figures 8, 9, 10, 11:
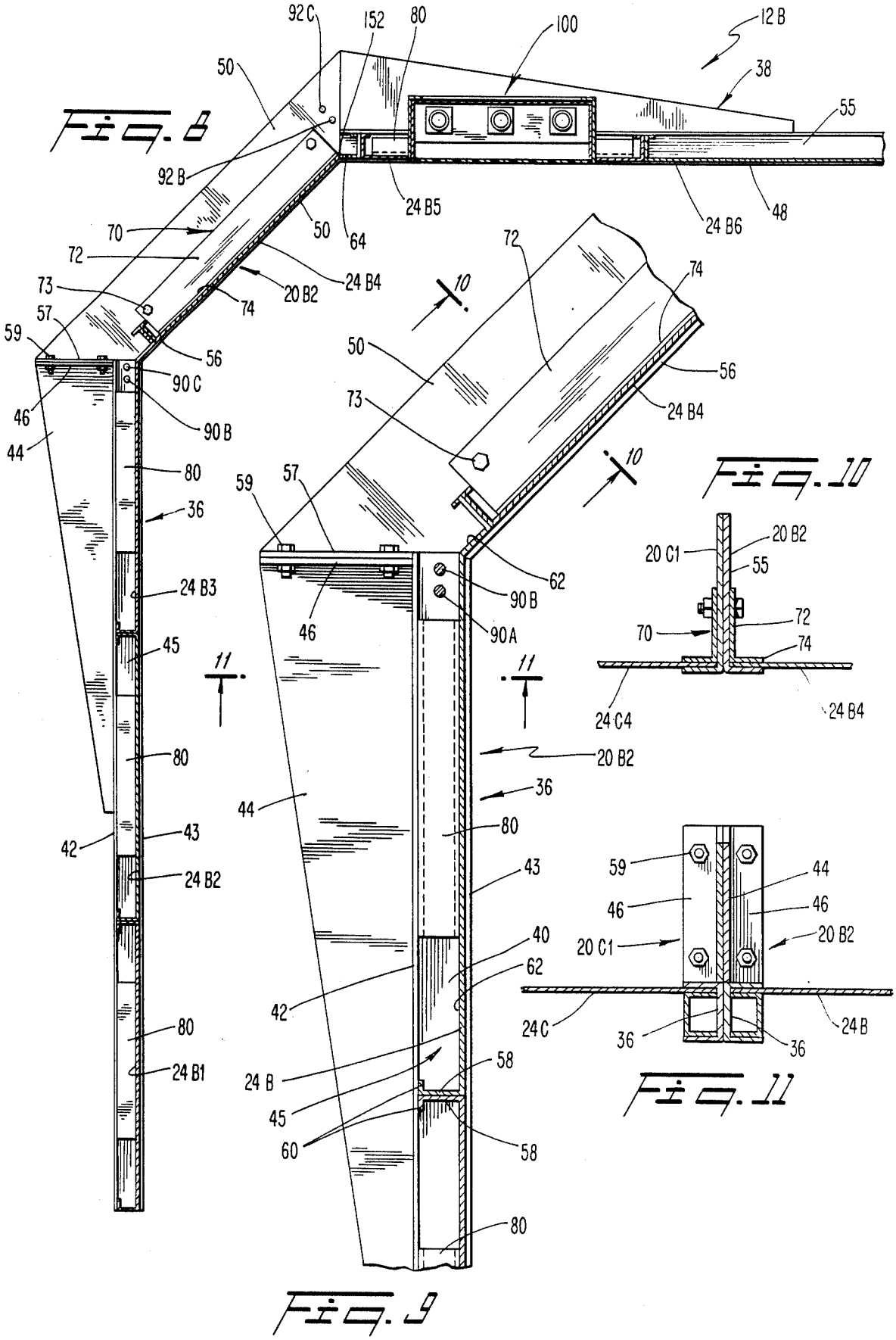
FIG. 8 is a partial cross-sectional view taken along the line 8—8 in FIG. 1.
FIG. 9 is an enlarged view of a portion of the structure depicted in FIG. 8.
FIGS. 10 and 11 are cross-sectional views taken along lines 10—10 and 11—11, respectively, in FIG. 9.

Each of the frames 20, except frames 20C2 and 20D1, comprises a pair of upstanding posts 36 and a generally horizontal cross member 38 (FIG. 2) interconnecting the posts. The posts 36 each include a back wall 40 and a pair of mutually parallel legs 42, 43 projecting outwardly from the back wall to form a channel 45 (see FIG. 9). The spacing between the legs 42, 43 of each channel 45 is large enough to permit the ends of the wall panels 24 to be inserted into the channel. At its upper end the post 36 includes a welded-on flange 44 which has a horizontal ear 46 (FIG. 11).

The cross member 38 includes a central horizontal section 48 and a pair of inclined end sections 50 which extend downwardly at an oblique angle, preferably about 45 degrees, from opposite ends of the central section 48. The central and end sections 48, 50 are secured together by welding, or alternatively, by fasteners.

The central section 48 is of channel shape, i.e., it includes a base wall 52 and a pair of mutually parallel legs 53, 54 projecting at right angles from the base wall. The channel 55 defined between the legs 53, 54 is sufficient to receive the ends of the wall panels 24. The end sections 50 are each L-shaped and include a vertical flange 55 and a single integral leg 56 which extends a right angle relative to the flange 55 and at an oblique angle, preferably 45 degrees, relative to the channel 55. An ear 57 at the lower part of each end section 50 is connected by removable fasteners, such as bolts 59, to the ear 56 of the associated post 36.

The wall panels 24 each comprises a C-shaped sheet of metal (FIG. 9), the upper and lower horizontal edges of which each being bent twice to form an arm 58 and a lip 60. The arms 58 each extend perpendicularly from a back wall 62 of the panel, and the lips 60 each extend perpendicularly from the arms 58 so as to lie parallel to the back wall 62.

The ends of the wall panels 24 extend into the channels of the opposing frames 20. For example, each wall panel 24F of the modular section 12F has one end fitting into a channel 45 of the frame 20F1 and the other end fitting into a channel 45 of the frame 20F2 as can be seen in FIG. 2. Preferably, three wall panels 24 ("side" wall panels) extend along each of the posts 36 to form sides of the enclosure, e.g., see side wall panels 24A1, 24A2, 24A3 in FIG. 1. One wall panel 24 (an "inclined" wall panel) extends along each of the inclined sections 50, e.g., see inclined wall panel 24A4 in FIG. L. Four wall panels 24 ("overhead" wall panels) extend along the central section 48 of the frame 20, e.g., see overhead wall panels 24A5–24A8 in FIG. 1. Thus, each of the modular sections, except section 12D comprises two frames 20 and twelve wall panels. The modular section 12D is different because in lieu of the wall panels on one side of the modular section, an access door 60 is provided, as will be discussed hereinafter.

The wall panels along the sides of the structure are laid one upon the other. Thus, with reference to FIG. 8, the bottom arm 58 of a lowermost side wall panel 24B1 at each side of the structure rests upon the ground. The bottom arm 58 of the next higher wall panel, i.e., the intermediate side wall panel 24B2, bears against the top arm 58 of the lowermost side wall panel 24B1. The bottom arm 58 of the next higher side wall panel, i.e., the top wall panel 24B3, bears against the uppermost arm 58 of the intermediate side wall panel 24B2. The upper end 62 of the top side wall panel 24B3 is bent at an oblique angle, i.e., preferably at 45 degrees so as to extend along the leg 56 of the associated end section 50 of the frame 20B2. Thus, the uppermost arm 58 of the top side wall panel 24B3 extends at an acute angle relative to vertical. The inclined wall panel 24B4 has its lowermost arm 58 bearing against the uppermost arm 58 of the top side wall panel 24B3. The upper end 64 of the inclined wall panel 24B4 is bent, preferably at 45 degrees, so as to lie substantially horizontally. The side wall panels on the other side of the frame are similarly arranged, and the space between the upper ends 64 is occupied by the overhead wall panels 24B5–24B8.

An L-shaped locking plate 70 (FIG. 8) is removably secured to a respective end section 50. That is, the locking plate 70 includes a vertical flange 72 which is secured by bolts 73 to the flange 55 of the end section 50, and also includes a leg 74 which bears against the top surface of the inclined wall panel 24B4. The locking plate is installed after the inclined wall panel 24B4 has been inserted between the frames 20B1, 20B2.

The wall panels 24 are held against rattling within the respective channels of the frames 36, 38 by means of U-shaped inserts 80 (FIG. 2). The inserts are preferably formed of sheet metal and include parallel legs 82 which are interconnected by a bight 84. Installation of the inserts is effected after the respective wall panels have been installed within the channels of the frames. The inserts 8 are installed legs-first into the channels. The spacing between the legs 82 is dimensioned so that one of the legs 82 bears against one of the legs 42 of the channel, and the other insert leg 82 bears against the back wall 62 of the wall panel 24, such engagement being by friction-fit to tightly press the wall panel 24 against the other channel leg 43.

Figure 3:
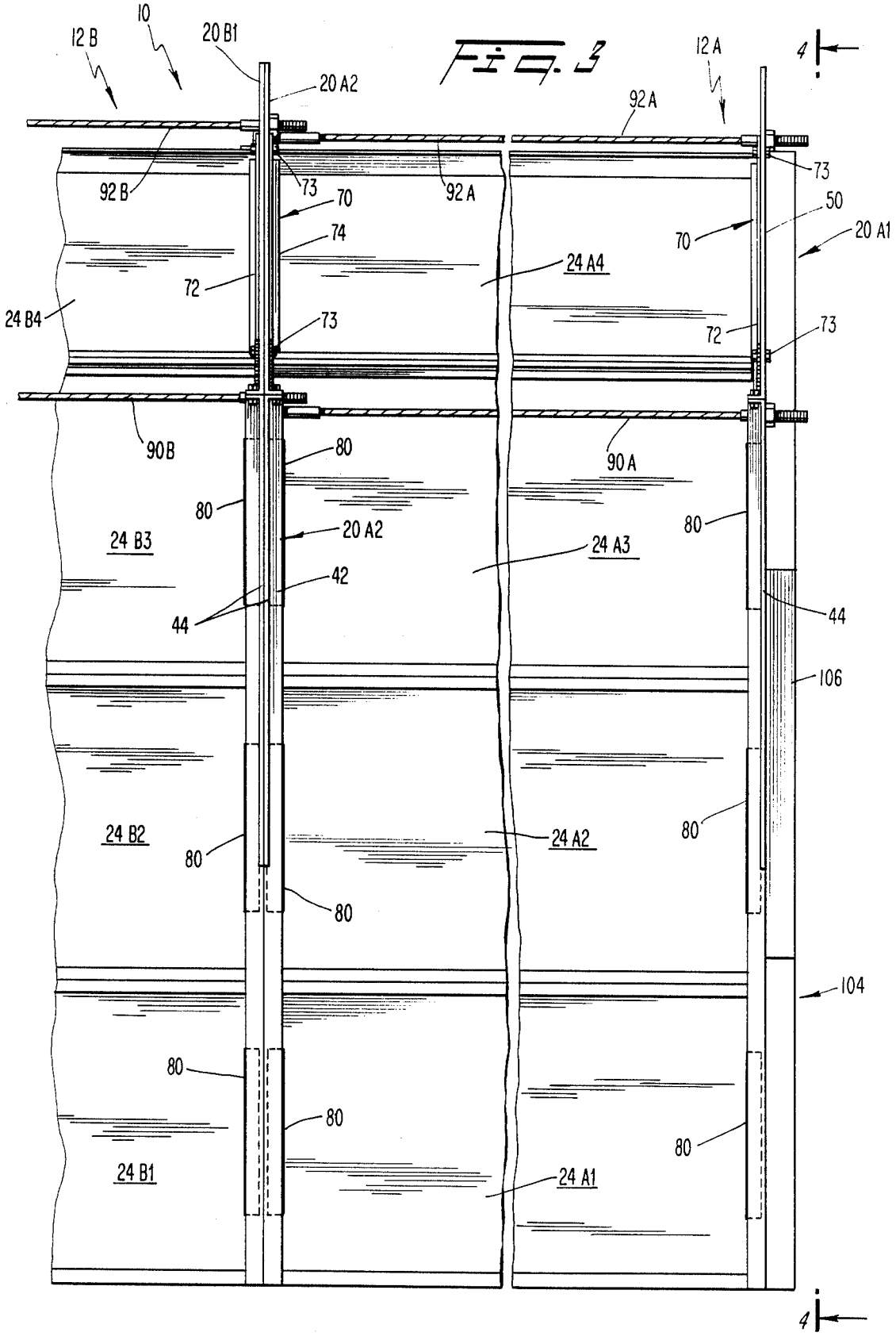
FIG. 3 is a fragmentary side elevational view of a portion of the enclosure.

Each module 12 is secured together in the fore-aft (longitudinal) direction by means of cables 90, 92 extending in the fore-aft direction. With reference to FIG. 3, lower and upper cables 90A, 92A secure the module 12A in the fore-aft direction. One end of the lower cable 90A (i.e., the right-hand end in FIG. 3) passes through the post 36 of the frame 20A1 of the module 12A. The other end (i.e., the left-hand end in FIG. 3) of the lower cable 90A passes through the posts 36 of the frames 20A, 20B1. The upper cable 92A has one end extending through the leg 55 of the frame 20A1 and another end passing through the legs 55 of the frames 20A2 and 20B1. Thus, the cables 90A, 92A interconnect the two frames 20 of a given module (e.g., the frames 20A1, 20A2 of the module 12A), and also connect a frame of the next module to that given module (e.g., the frame 20B1 is connected to the frame 20A2). The cables also serve to pull the frames against the ends of the wall panels to secure the latter in the longitudinal direction. Securement of the wall panels in the transverse direction is achieved by the legs 42, 43 of the channels which define receivers for the ends of the wall panels.

Some of the wall panels 24 can be fitted with electric light fixtures 100 or with windows to admit ambient light into the enclosure chamber.

Figure 1:
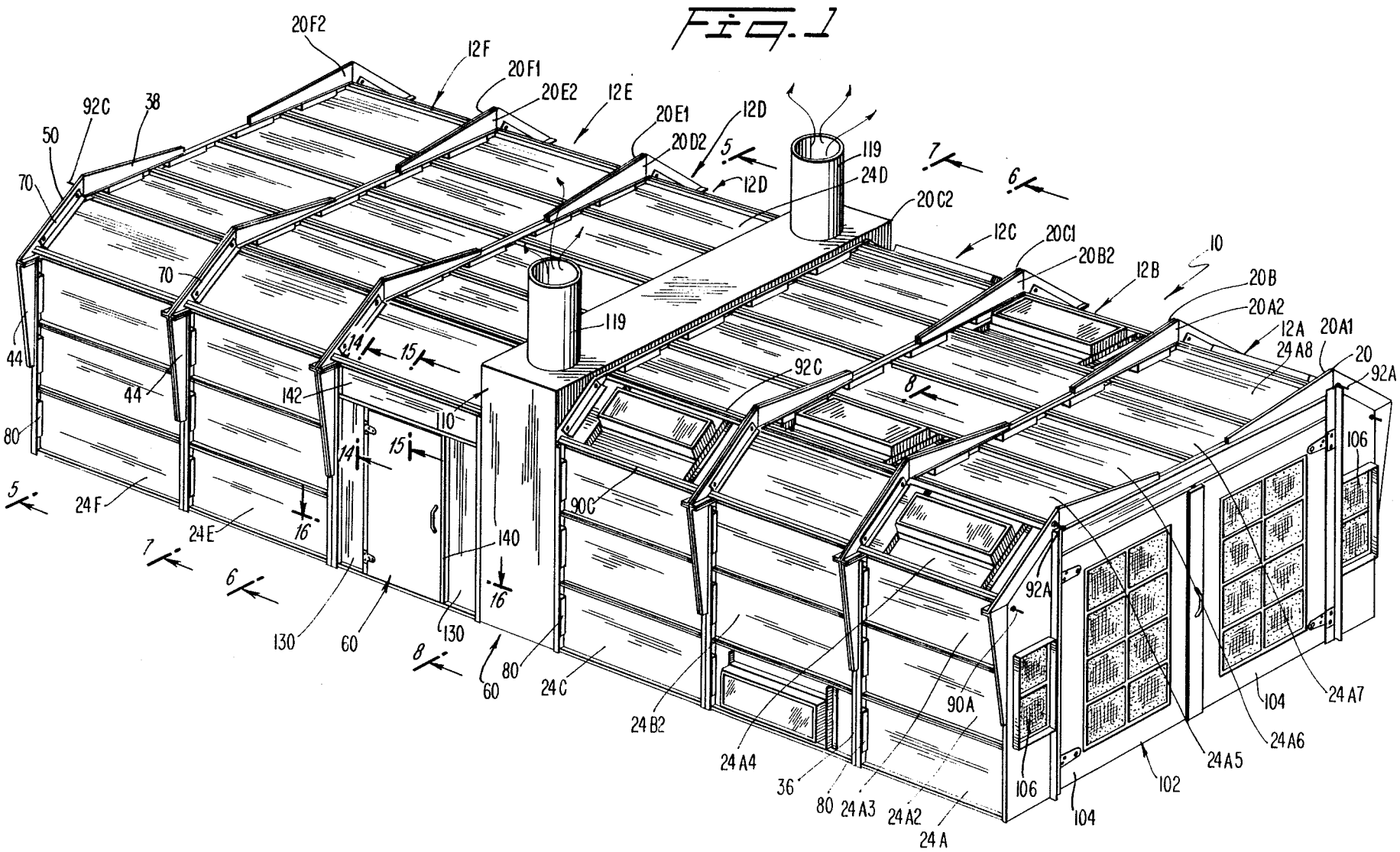
FIG. 1 is a perspective view of an enclosure constructed in accordance with the present invention.
Figure 4:
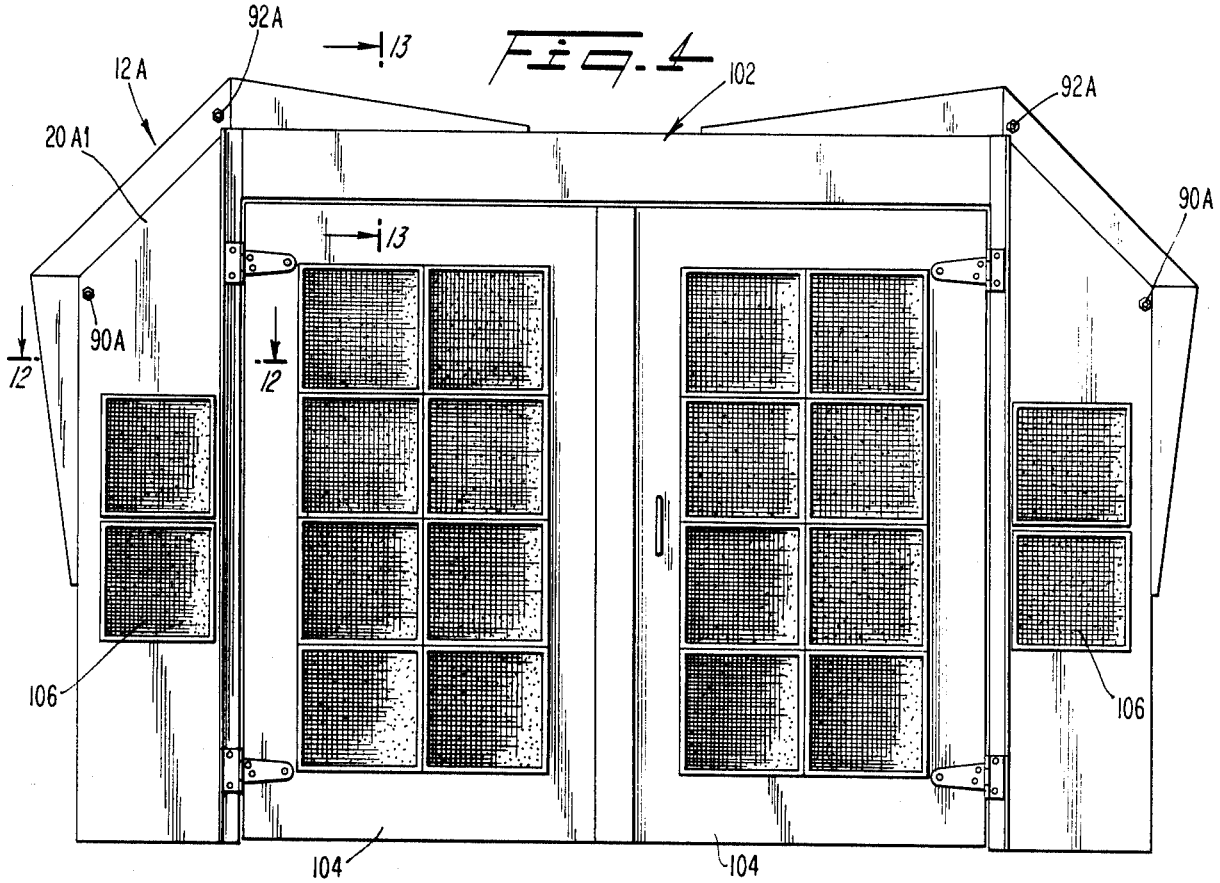
FIG. 4 is an end elevational view of the enclosure with doors thereof in a closed condition, taken in the direction of line 4—4 in FIG. 3.

The endmost ones 12A, 12F of the modules are provided with end walls 102 (only one end wall depicted in FIG. 1). The end wall 102 is integral with the frame 20A1 in that it carries the channels 45, 55 and has the cables 90A 92A attached thereto. The end wall 102 may carry doors 104 (FIG. 4) to provide access to the interior chamber 11. Air vents 106 may be provided in the doors and/or the surrounding part of the end wall 102 to provide for proper ventilation of the chamber.

Figure 6:
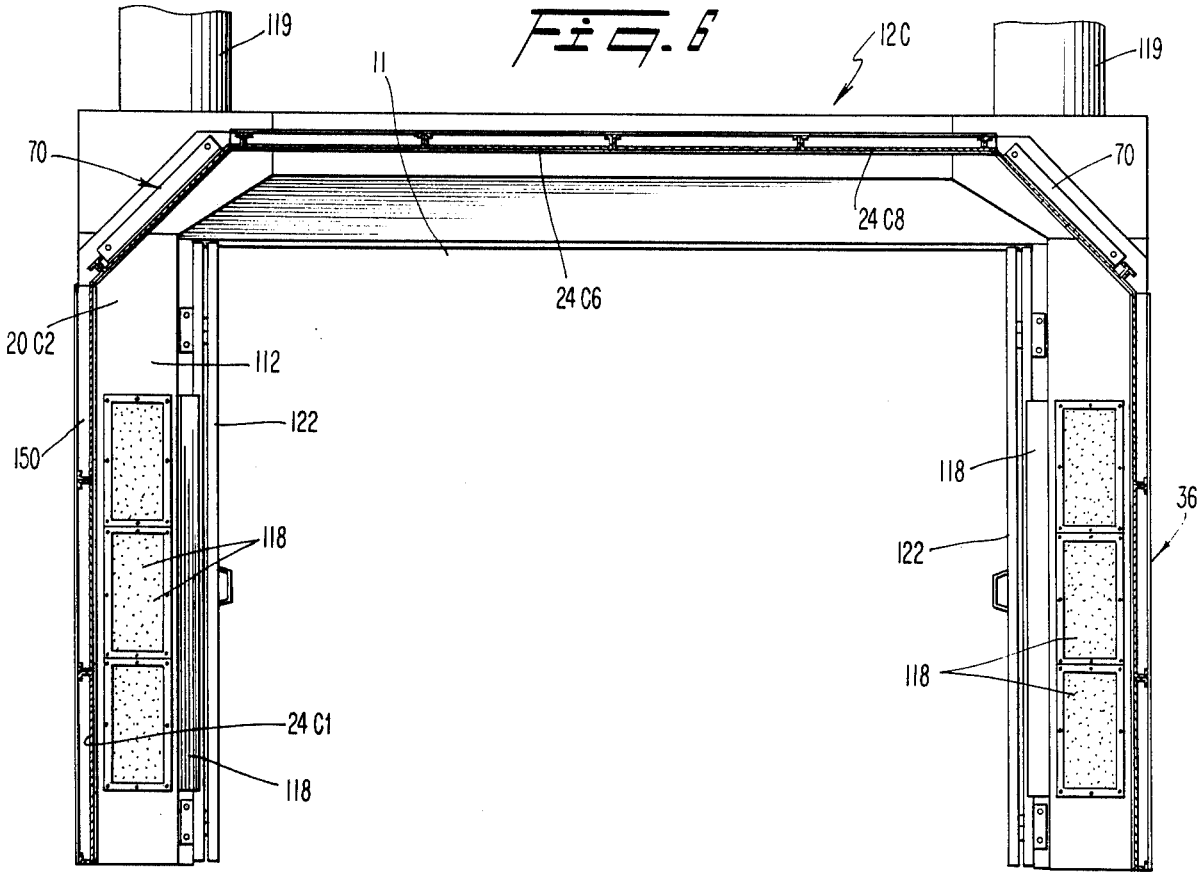
FIG. 6 is a cross-sectional view through a module of the enclosure, taken along a line 6—6 in FIG. 1 and directed so as to view a ventilation section of the enclosure, with doors on the ventilation section being open.
Figure 7:
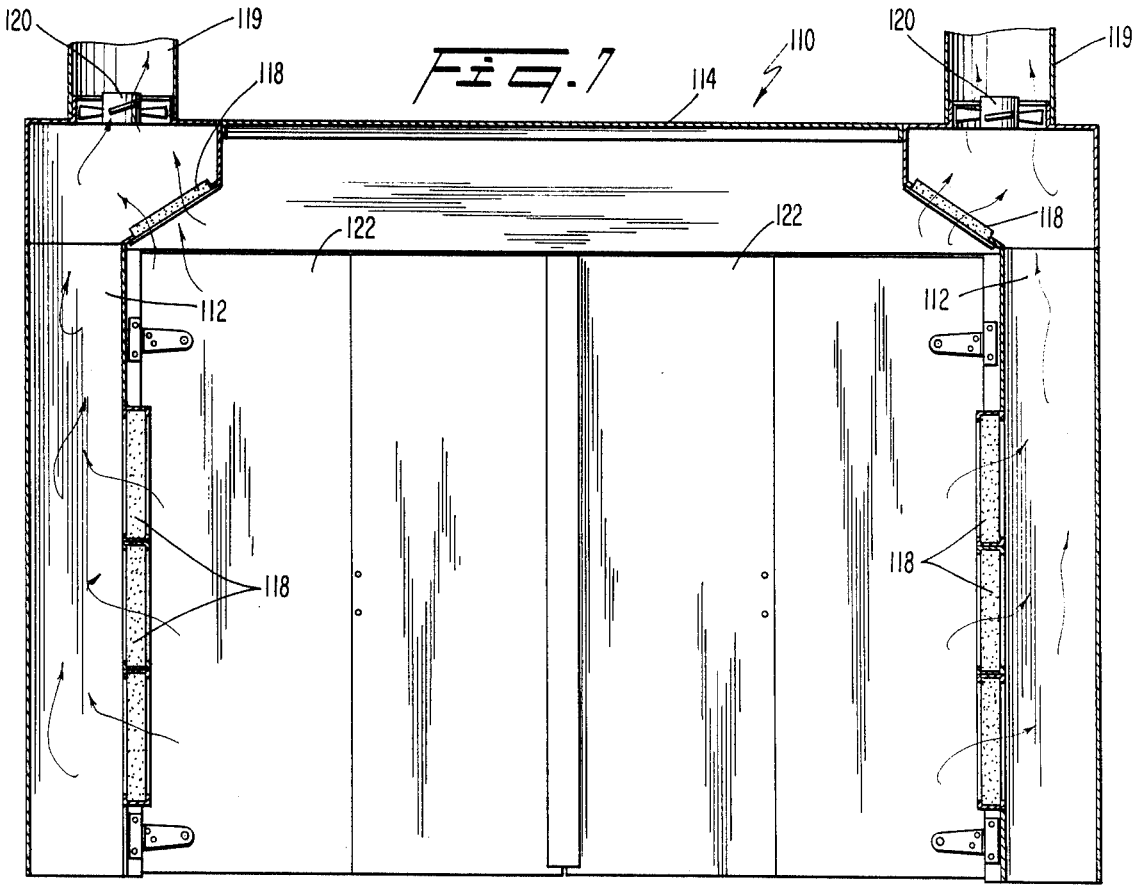
FIG. 7 is a cross-sectional view through the ventilation section, taken along line 7—7 in FIG. 1, with the doors on the ventilation section in a closed condition to divide the interior of the enclosure into two sections, one in which automobiles are painted and another in which the painted automobiles are dried.

One particularly advantageous use of the present invention is as an automobile painting and drying unit. To that end, there is provided an exhaust section 110 (FIGS. 1, 6, 7) intermediate two of the modules 12C, 12D. That exhaust section comprises a hollow converted U-shaped structure comprising a pair of upright hollow columns 112 interconnected by a plate 114 (FIG. 6). The hollow columns 112 each include openings which communicate with the chamber and which are covered by filters 118 to filter air which is sucked through the openings 116 by exhaust fans 120 situated within chimneys 119 at the upper ends of the columns 112. Thus, if one-half of the chamber is employed as an automobile painting section (i.e., the half formed by the modules 12A, 12B, 12C), a continuous air flow is established through that chamber half by the exhaust fans 120. That is, ambient air is sucked-in through the aforementioned air vents 106 in the end wall 102 and travels through the chamber to entrain paint particles therein before being exhausted through the filters 118.

Hingedly attached to the exhaust section are a pair of folding doors 122 which, when closed, separate the chamber 11 into chamber sections, i.e., the afore-mentioned painting section and drying section are formed by the modules 12D, 12E, 12F. Within the drying section are disposed high intensity heat lamps 123 (FIG. 5) for drying the paint. The heat lamps are mounted on the inside surfaces of the wall panels 24.

The access door 60 is disposed in the side of one of the modules 12D of the drying section. In the region where the access door is disposed, wall panels 24 are not employed. Rather, a pair of upright panels 130 are provided which are C-shaped in horizontal cross-section (see FIG. 16). One vertical edge 132 of one panel 130 is situated within the channel 45 of a frame 20D2, and a vertical edge 134 of the other panel 130 is situated in a channel 136 attached to the ventilation section 110. Vertical strips 140 are fastened to the other vertical edges of the panels 130, and the door 60 is hinged to one of those strips 140. A panel 142 similar to the wall panels 24, but shorter in width, is mounted above the door and vertical panels 130 (FIG. 1). The upper longitudinal portion 143 of that panel 142 is bent in a manner similar to the portion 62 of panel 24B3 for example (see FIG. 14). An inverted U-shaped bar 144 is disposed between the upper edge of the door 60 and the panel 142 (see FIG. 15).

Assemblage of the enclosure 10 is achieved by first erecting the ventilation section 110. One end of a lowermost wall panel 24C1 is then inserted into a channel 150 affixed to a side of the ventilation section (opposite the side to which the channel 136 is affixed). Then, a frame unit comprising a pair of interconnected frames 20B2 and 20C1 is raised and positioned such that the other end of the wall panel 24C1 is disposed in the channel 36 thereof. This serves to properly space the frame 20C1 from the ventilation section 110. Thereafter, the lower cables 90C are interconnected between the ventilation section 110 and the frame unti 20B2, 20C1 on both sides of the enclosure to secure the spacial relationship between the frame 20C1 and the ventilation unit. Thereafter, the remaining two side wall panels 24C2, 24C3 on each side of the enclosure are slid downwardly, their ends sliding within the vertical channel 150 of the ventilation section 110 and the vertical channel 45 of the frame 20C1. Next, the upper cables 92C are interconnected between the exhaust section 110 and the frame 20C1, and the four overhead wall panels 24C5–24C8 are slid horizontally, their ends sliding within the the horizontal channel 55 of the connecting member 38 of the frame 20C1 and a horizontal channel 152 secured to an upper portion of the exhaust section 110. Thereafter, each inclined wall panel 24C4 is installed by first inserting its upper bent end 64 (FIG. 8) into the horizontal channels 55, 152 while flexing its opposite lower end upwardly about a fulcrum 152 (FIG. 6) to avoid contact with the upper bent end 62 of the uppermost side wall panel 24C3. At that point, the inclined wall panel 24C4 is released and its lower end snaps down to a position against the upper edge of the uppermost side wall 24C3. At this point, the locking plates 70 are installed above the inclined wall panels 24C4. Finally, the locking wedges 80 are press-fit into the channels to tightly press the side and overhead wall panels against the vertical channel legs 43 and the horizontal channel legs 54, thereby resisting rattling of the wall panels.

Next, the module 12B is attached to the module 12C in the same manner as described above, followed by the module 12A. The module 12D is then attached to the opposite side of the ventilation section 110, followed sequentially by assemblage of the modules 12E and 12F.

It will be appreciated that the enclosure 10 can be assembled and disassembled employing a minimal number of fasteners. The primary forces securing the enclosure in the longitudinal direction are imposed by the cables 90, 92 which forces press the wall panels within the respective channels. By releasing the cables, the modules can be quickly disassembled. Thus, no appreciable lost time results from rusted bolts or misaligned bolt holes.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. An enclosure comprising:

a pair of frames spaced apart in a longitudinal direction, each frame including a pair of upstanding portions and a connecting portion interconnecting upper ends of said upstanding portions, said connecting portion of each frame including a horizontal section and two obliquely inclined sections joined respectively to said upper ends of said upstanding portions of such frame to form joints at each side of said enclosure, each frame including receiver means in said upstanding and connecting portions, with the receiver means of each frame facing toward the receiver means of the other frame, a plurality of wall panels extending in said lognitudinal direction between said frames along said upstanding and connecting portions, each of said wall panels including at least one longitudinal edge bearing against the longitudinal edge of an adjacent panel so that each panel provides support to at least one adjoining wall panel, each wall panel including one longitudinal end mating with the receiver means of one said frame to prevent lateral movement of said one end, and an opposite longitudinal end mating with said receiver means of the other said frame to prevent lateral movement of said second end, two of said wall panels constituting the uppermost panels disposed along said frame upstanding portions each having an upper longitudinal edge, two others of said panels being horizontally disposed wall panels arranged in adjoining relationship to two inclined wall panels, said inclined wall panels including a topmost longitudinal edge and said adjoining horizontal wall panels including outer longitudinal edges, one of said topmost longitudinal edge of said inclined wall panel or said outer longitudinal edge of said horizontal panel, at each said side of said enclosure, being bent at an acute angle relative to the remaining portion of its wall panel so as to bear against the other of said topmost and outer longitudinal edges thereby providing support to the wall panel against which the bent longitudinal edge abuts, wherein said inclined sections include legs upon which said inclined panels rest, a pair of locking plates removably secured to said inclined sections and each including a leg positioned above a respective inclined wall panel to prevent removal thereof, and elongate tensioning means having one end connected to one frame of said pair of frames and another end connected to the other frame of said pair of frames, said tensioning means extending longitudinally between said pair of frames and being tensioned to urge said frames toward one another and against said ends of said panels.

2. An enclosure comprising:

a pair of frames spaced apart in a longitudinal direction, each frame including a pair of upstanding portions and a connecting portion interconnecting upper ends of said upstanding portions, each frame including receiver means in said upstanding and connecting portions, with the receiver means of each frame facing toward the receiver means of the other frame, said connecting portion of each frame including two obliquely inclined sections joined respectively to said upper ends of said upright end of such frame, a plurality of wall panels extending in said longitudinal direction between said frames along said upstanding and connecting portions, each of said wall panels including at least one longitudinal edge bearing against the longitudinal edge of an adjacent panel so that each panel provides support to at least one adjoining wall panel, each wall panel including one longitudinal end mating with the receiver means of one said frame to prevent lateral movement of said one end, and an opposite longitudinal end mating with said receiver means of the other said frame to prevent lateral movement of said second end, two of said wall panels defining inclined wall panels resting upon a leg of said inclined sections, respectively, and a pair of locking plates removably sectioned to said inclined sections and including a leg positioned above said inclined wall panel to prevent removal thereof; and elongate tensioning means having one end connected to one frame of said pair of frames and another end connected to the other frame of said pair of frames, said tensioning means extending longitudinally between said pair of frames and being tensioned to urge said frames toward one another and against said ends of said panels.

3. An enclosure comprising:

(A) a plurality of modules aligned in a longitudinal direction, and including a pair of end modules, each module comprising (1) a pair of frames spaced apart in a longitudinal direction, (i) each frame including a pair of upstanding portions and a connecting portion interconnecting upper edges of said upstanding portions, said connecting portion of each frame including a horizontal section and two obliquely inclined sections joined respectively to said upper ends of said upstanding portions of such frame to form joints at each side of said enclosure, (ii) each frame including channel means in said upstanding and connecting portions, with the channel means of each frame opening toward the channel means of the other frame, and (2) a plurality of wall panels extending in said longitudinal direction between said frames along said upstanding and connecting portions, said wall panels including longitudinal edges bearing against the longitudinal edges of adjacent wall panels so that each panel provides support to adjoining wall panels, (i) each wall panel including one longitudinal end disposed in the channel means of one of said frames and an opposite longitudinal end disposed in the channel means of the other frame, two of said wall panels constituting the uppermost panels disposed along said frame upstanding portions each having an upper longitudinal edge, two others of said wall panels defining inclined wall panels extending along said inclined sections of said frame each including a lower longitudinal edge of said uppermost panel or said lower longitudinal edge of said inclined wall panel, at each said side of said enclosure, being bent at an acute angle relative to the remaining portion of its wall panel so as to bear against the other of said upper and lower longitudinal edges thereby providing support to the wall panel against which the bent longitudinal edge abuts, said wall panels further including a plurality of horizontally disposed wall panels extending along said horizontal sections of said frames, two of said horizontally disposed wall panels arranged in adjoining relationship to said inclined wall panels, said inclined wall panels including a topmost longitudinal edge and said adjoining horizontal wall panels including outer longitudinal edges, one of said topmost longitudinal edge of said inclined wall panel or said outer longitudinal edge of said horizontal wall panel, at each side of said enclosure, being bent at an acute angle relative to the remaining portion of its wall panel so as to bear against the other of said topmost and outer longitudinal edges thereby providing support to the wall panel against which the bent longitudinal edge abuts, wherein said inclined sections include legs upon which said inclined panels rest, a pair of locking plates removably secured to said inclined sections and each including a leg postioned above a respective inclined wall panel to prevent removal thereof, (B) cable means having one end connected to one frame of said pair of frames and another end connected to the other frame of said pair of frames, said cable means extending longitudinally between said frames and being tensioned to urge said frames of all of said modules toward one another to longitudinally secure said wall panels within their respective channels, and (C) end wall means closing off opposed longitudinal ends of the enclosure.

4. An enclosure comprising:

(A) a plurality of modules aligned in a longitudinal direction, and including a pair of end modules, each module comprising (1) a pair of frames spaced apart in a longitudinal direction, (i) each frame including a pair of upstanding portions and a connecting portion interconnecting upper edges of said upstanding portions, said connecting portion of each frame including two obliquely inclined sections joined respectively to said upper ends of said upstanding end of such frame, (ii) each frame including channel means in said upstanding and connecting portions, with the channel means of each frame opening toward the channel means of the other frame, and (2) a plurality of wall panels extending in said longitudinal direction between said frames along said upstanding and connecting portions, said wall panels including longitudinal edges bearing against the longitudinal edges of adjacent wall panels so that each panel provides support to adjoining wall panels, (i) each wall panel including one longitudinal end disposed in the channel means of one of said frames and an opposite longitudinal end disposed in the channel means of the other frame, two of said wall panels defining inclined wall panels resting upon a leg of said inclined sections, respectively, and a pair of locking plates removably sectioned to said inclined sections and including a leg positioned above said inclined wall panel to prevent removal thereof.

(B) cable means having one end connected to one frame of said pair of frames and another end connected to the other frame of said pair of frames, said cable means extending longitudinally between said frames and being tensioned to urge said frames of all of said modules toward one another to longitudinal secure said wall panels within their respective channels, and (C) end wall means closing off opposed longitudinal ends of the enclosure.

* * * * *